United States Patent [19]

Ziemba

[11] 3,955,069

[45] May 4, 1976

[54] PRESETTABLE COUNTER

[75] Inventor: Richard T. Ziemba, Burlington, Vt.

[73] Assignee: General Electric Company, Burlington, Vt.

[22] Filed: Nov. 29, 1973

[21] Appl. No.: 420,358

Related U.S. Application Data

[62] Division of Ser. No. 292,966, Sept. 28, 1973, Pat. No. 3,844,217.

[52] U.S. Cl. ..... 235/92 PE; 235/92 R; 328/48

[51] Int. Cl.[2] ..... G06M 3/02; H03K 21/36

[58] Field of Search .... 235/92 PE, 92 MS, 61.11 A, 235/61.11 D; 89/6; 340/347 P, 146.3 Z; 328/48; 307/220 R

[56] References Cited

UNITED STATES PATENTS

| | | | |
|---|---|---|---|
| 2,964,734 | 12/1960 | West | 340/146.3 Z |
| 3,108,254 | 10/1963 | Dimond | 340/146.3 Z |
| 3,371,579 | 3/1968 | Kinzelman | 235/92 MS |
| 3,485,168 | 12/1969 | Martinson | 340/146.3 Z |

*Primary Examiner*—Joseph M. Thesz, Jr.
*Attorney, Agent, or Firm*—Bailin L. Kuch

[57] ABSTRACT

An electronic, digital, time fuze is disclosed having a counter which may be initially preset mechanically before flight, and which may subsequently be changed during a predetermined interval during flight, by a radar command link. Several mechanical presetting mechanisms for the counter are also disclosed.

3 Claims, 14 Drawing Figures

Fig. 1.
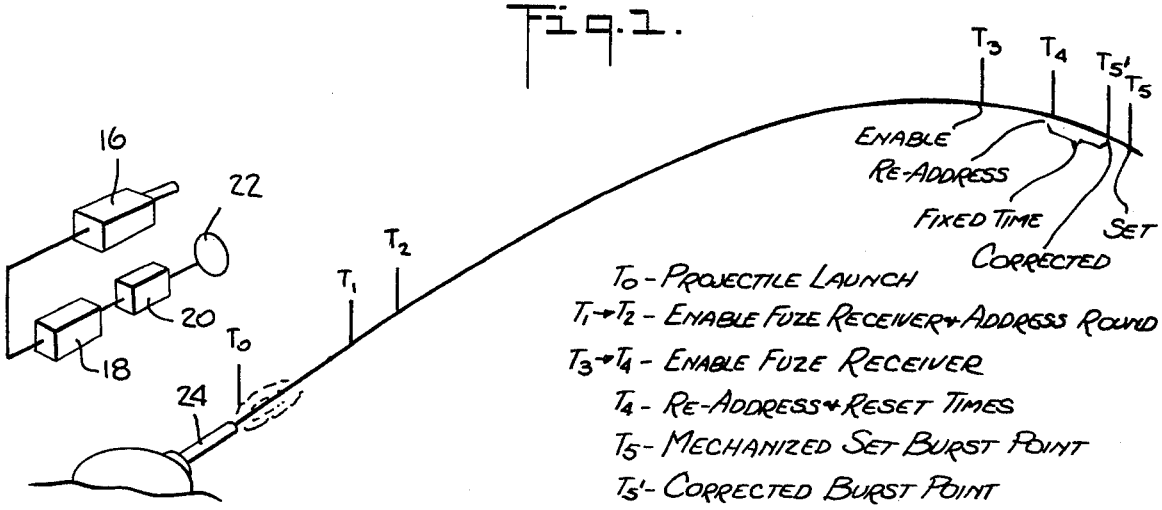
Fig. 2B.
Fig. 2A.
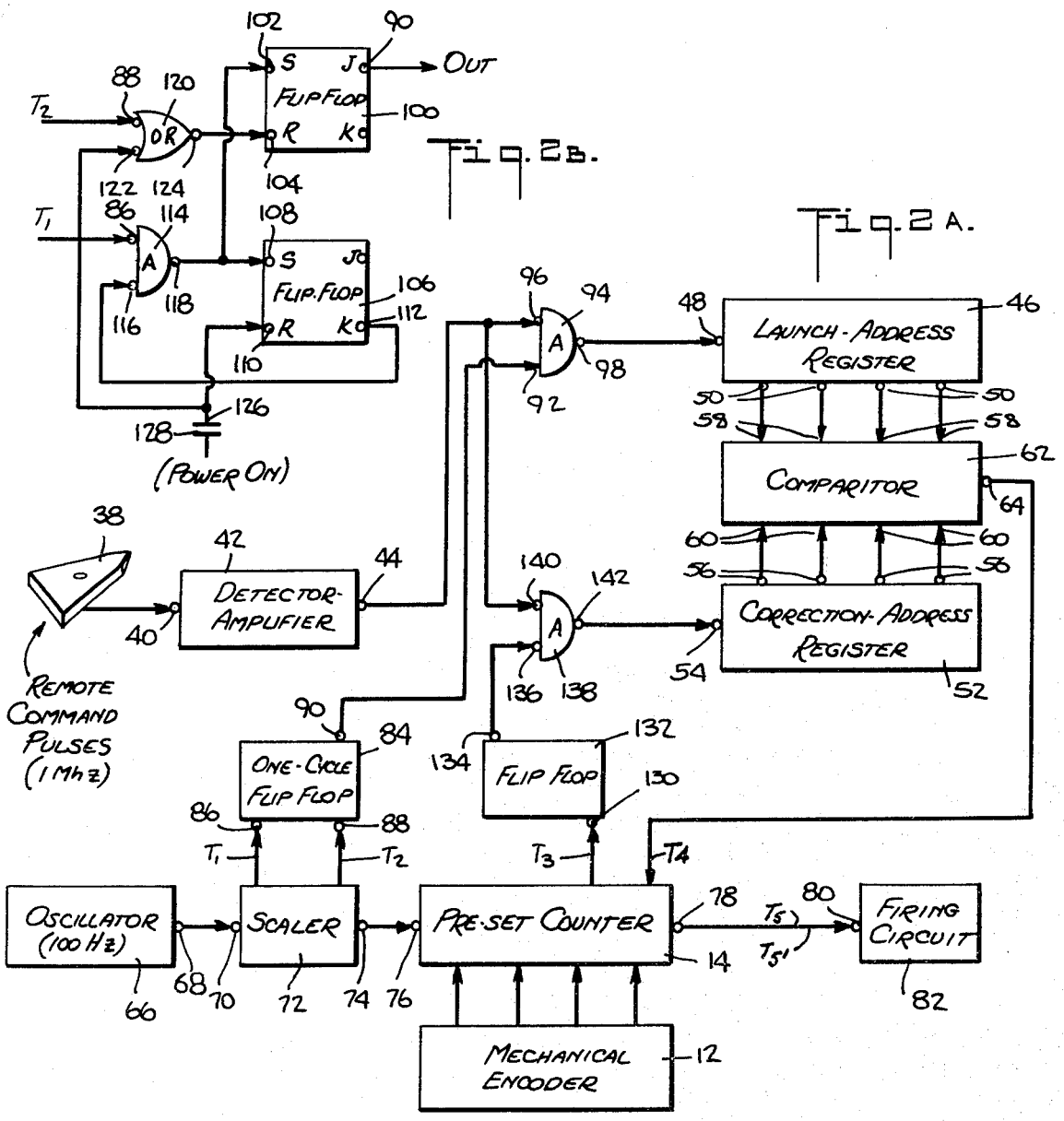

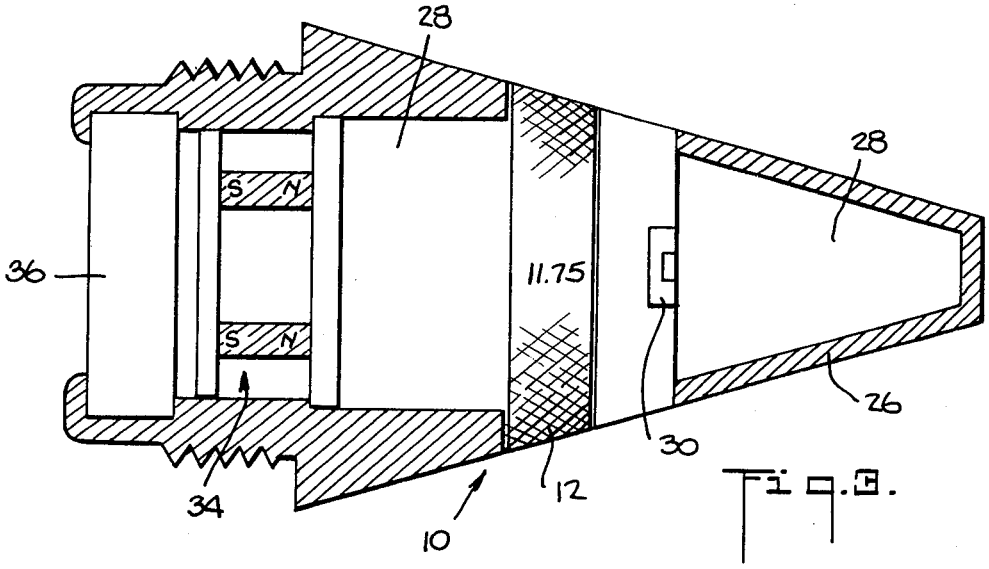
Fig. 3.
Fig. 4.
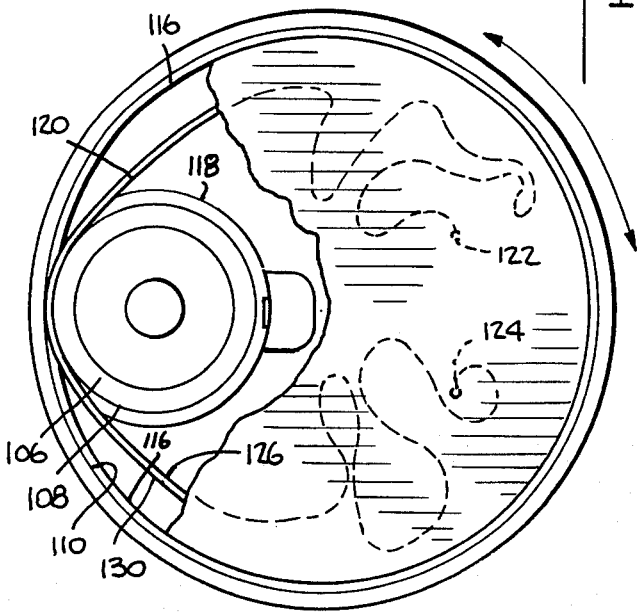
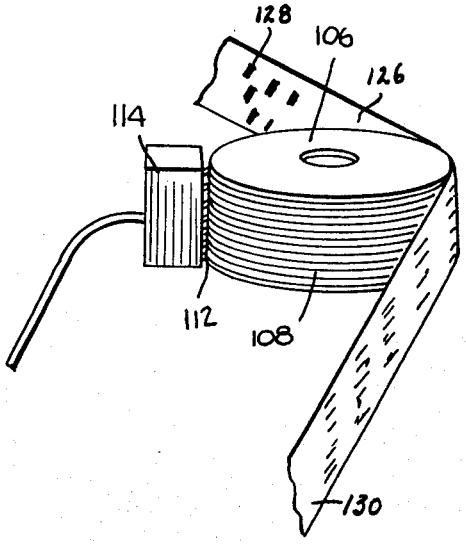
Fig. 6.
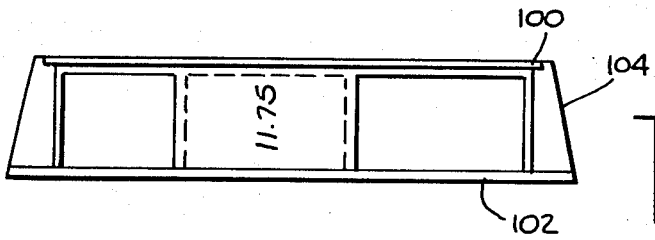
Fig. 5.

Numeric To Digital Logic
Improved Segment Pattern
Chip
Counter
Scaler
X10
X10
All Present
200
202
204
206
208
210
212
214
216
217
218
220
222
224
226
66
82
12
14

PRESETTABLE COUNTER

RELATED APPLICATION

This application is a division of U.S. Pat. No. 3,844,217, issued Oct. 29, 1974 Ser. No. 292,966 filed Sept. 28, 1973.

BACKGROUND OF INVENTION

1. Field of Art

This invention relates generally to fuze actuating systems, and especially to systems having an inflight variable range adjustment. rate 2. Prior Art In my earlier application, Ser. No. 843,478 filed July 22, 1969, now U.S. Pat. No. 3,714,898 there is shown an electronic, digital, time fuze, whose time base is introduced, during the entire interval of flight, over a radar command link at a rat which is inversely proportional to the desired projectile flight time.

In a subsequent application, now U.S. Pat. No. 3,670,652, issued June 20, 1972, I have shown an electronic digital time fuze having a counter which also serves as a serial programmer and which may be remotely preset while in flight to enable a proximity detector circuit at a first predetermined range, and to self detonate the fuze, if not sooner detonated by the proximity detector circuit, at a second predetermined range.

In a companion application to Ser. No. 843,478, R. Leightner in U.S. Pat. No. 3,599,016, issued Aug. 10, 1971, has shown a reset circuit adapted to automatically set a counter to zero upon the initial application of power to the counter. That reset circuit may be utilized with any embodiment of this invention, as may be required.

BRIEF SUMMARY OF THE INVENTION

It is an object and a feature of this invention to provide an improved electronic, digital, time fuze, whose time base may be initially preset mechanically before flight; and which time base may subsequently be changed during a predetermined interval during flight, by a radar command link.

BRIEF DESCRIPTION OF THE DRAWING

This and other objects, features and advantages of the invention will be apparent from the following specification thereof taken in conjunction with the accompanying drawing in which:

FIG. 1 is a schematic view of the chronology of the flight of a fuze embodying this invention;

FIG. 2A is a block diagram of the fuze of FIG. 1;

FIG. 2B is a block diagram of a detail of FIG. 2A; of such

FIG. 3 is a longitudinal view of a fuze embodying this invention;

FIG. 4 is a transverse view of a first embodiment of a mechanical encoder for the fuze of FIG. 2;

FIG. 5 is a longitudinal view of the encoder of FIG. 4; and

FIG. 6 is a perspective view of the encoder of FIG. 4.

FIG. 9 illustrates the construction of a variant of the second embodiment of the encoder of FIG. 7C;

THE PREFERRED EMBODIMENT

Figures 7A, 7B, 7C, 8, 10, 11:
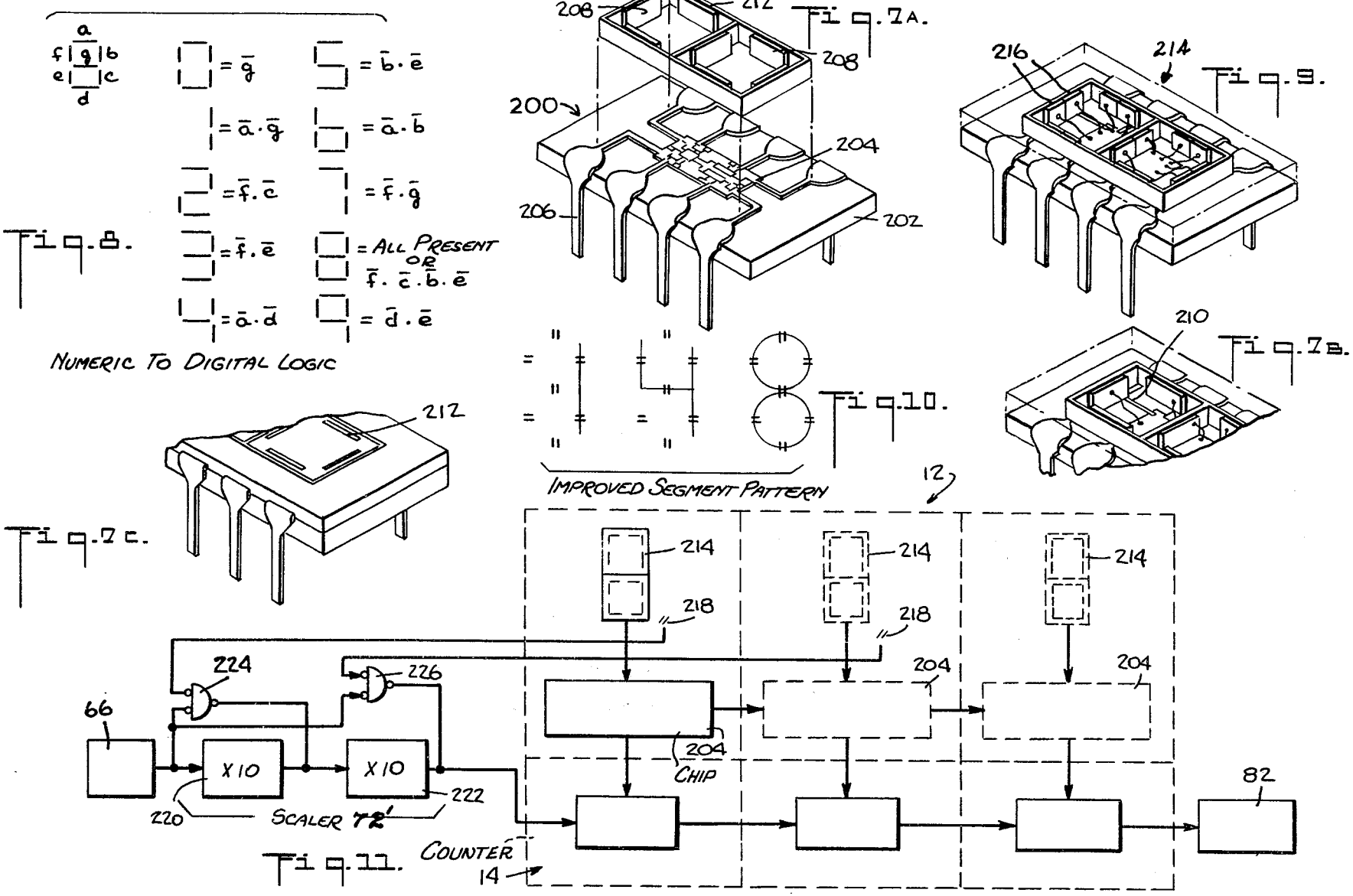
FIGS. 7A, 7B and 7C illustrate the construction of a second embodiment of a mechanical encoder for the fuze of FIG. 2.
FIG. 8 is a table of numeric to digital logic for the encoder of FIG. 7C.
FIG. 10 illustrates the penciling-in of a number on the encoder of FIG. 9.
FIG. 11 is a block diagram of a detail of a variant of the fuze of FIG. 2A.

The weapon system embodying this invention is similar in physical appearance to that shown in Ser. No. 843,478, except that the fuze 10 includes a mechanical encoder 12 to preset the main counter 14, which counter controls the interval of flight to detonation of the fuze.

The weapon system includes a command system which includes a ranging device, such as a laser 16, for ranging both the target and the projectile. The ranging device is coupled to a computer 18 which controls a pulse transmitter 20 which feeds a transmitting antenna 22. The weapon system further includes a projectile launching device such as a gun 24 which launches one or a plurality of projectiles, each containing a respective fuze 10, at the target.

The fuze may be manually or automatically mechanically set before projectile launch to a predicted interval of flight based upon fire control computed data. The fuze will detonate the projectile's warhead at the end of that interval in the absence of a correction received by the fuze during its flight to the target. This mechanical setting operation serves both as a coarse interval setting and as a back-up mode of operation in the event of a faulty electronic data link between and including the command system and the fuze. However, routinely, the data link will provide corrected interval to detonation data to the fuze prior to the detonation time which was predetermined by the mechanical encoder.

As seen in FIG. 3, the fuze 10 includes a housing 26, which may be secured into the warhead of the projectile, and which includes a receiver electronics assembly 28, a plurality of antenna ports 30, the encoder wheel assembly 12, a power supply here shown as an induction generator assembly 34, and a safing and arming mechanism 36.

The safing and arming mechanism 36 may be of the type shown in my U.S. Pat. No. 3,608,494, issued Sept. 28, 1971. The induction generator assembly 34 may include a permanent magnet, a coil, a diode and a capacitor, serving as the power supply to the fuze. The magnet is set back upon launch to generate a pulse in the coil which charges the capacitor.

As seen in FIG. 2, the fuze 10 functionally includes an antenna 38, which in turn includes the ports 30, and which is coupled to the input terminal 40 of a detector-amplifier circuit 42 having an output terminal 44. A "launch-address" register 46 has an input terminal 48 and an output group of terminals 50, and a "correction-address" register 52 has an input terminal 54 and an output group terminals 56. The two output groups of terminals 50 and 56 are coupled to respective input groups of terminals 58 and 60 of a comparitor circuit 62 which has an output terminal 64. A local oscillator 66 has an output terminal 68 coupled to the input terminal 70 of a decade scaling circuit 72, whose output terminal 74 is coupled to the input terminal 76 of the decade counter 14, whose output terminal 78 is coupled to the input terminal 80 of the firing circuit 82. The decade mechanical encoder 12 is coupled to the decade counter 14 as shown in FIG. 6.

Time $T_0$, which is the time of projectile launch, may be established for the purposes of the command system computer 18, by detecting the application of firing current to the round of ammunition when it is fired from the gun, and then allowing a predetermined interval for the projectile to leave the gun tube. Alternatively, a pick-up coil may be located adjacent to the end of the gun tube to detect the passage of the projectile from the tube. Time $T_0$ is established for the purposes of the fuze by the set-back of the permanent magnet generating a pulse in the coil to charge the capacitor through the diode, and then allowing a predetermined interval for the projectile to leave the gun tube. Alternatively, power may be supplied by a battery as shown in U.S. Pat. No. 3,608,494, supra.

Time $T_5$, which is the time of detonation, is established by the full count configuration of the counter 14 created by the mechanical encoder 12, and the rate at which pulses are fed to the counter by the oscillator 66 via the scaler 72.

A random number address is to be inserted into the "launch-address" register 46 after launch and before the fuze enters the cloud of gun gas generated by the firing of the round. This interval of time for addressing the register from the command system is defined by times $T_1$ and $T_2$ which are represented by signals which are tapped off from appropriate decades of the scaler 72 only during the first cycle of operation of the scaler. This is accomplished by a one-cycle only flip-flop assembly 84, which is shown in greater detail in FIG. 2B, and which has a $T_1$ input terminal 86, a $T_2$ input terminal 88, and a $T_1$–$T_2$ interval-on output terminal 90. Terminal 90 is coupled to a first input terminal 92 of an AND gate 94, which has a second input terminal 96 coupled to the output terminal 44 of the detector amplifier 42, and an output terminal 98 coupled to the input terminal 48 of the "launch-address" register 46. Thus, during the interval $T_1$–$T_2$, the AND gate 94 is enabled by the scaler 72, and is able to pass command pulses to the register 46.

As shown in FIG. 2B, the one-cycle-only flip-flop assembly 84 may be embodied as a first flip-flop 100, having a set input terminal 102, a reset input terminal 104, and a J-output terminal 90; a second flip-flop 106 having a set input terminal 108, a reset input terminal 110, and a K-output terminal 112; and AND gate 114, having a first input terminal 86, a second input terminal 116, and an output terminal 118; and an OR gate 120, having a first input terminal 88, a second input terminal 122, and an output terminal 124. Terminals 110 and 122 are coupled to the output terminal 126 of an infeed capacitor 128, and are turned on when power is initially applied to the circuit, thereby turning on terminal 112 and keeping terminal 90 off. Terminals 118, 108 and 102 are intercoupled, and terminals 112 and 116 are intercoupled. At time $T_1$, AND gate 114 conducts, turning on terminals 102 and 108, thereby turning on terminal 90 and turning off terminal 112, and thereby disabling the AND gate 114. At time $T_2$, OR gate 120 conducts, turning on terminal 104, thereby turning off terminal 90. During subsequent cycles of the scaler, so long as power remains on without interruption, terminal 112 remains off, and a $T_1$ signal cannot make the AND gate 114 conduct.

During the major interval of time of flight, $T_2$–$T_3$, the projectile and the target may be tracked by the command system, and a corrected time to detonation may be determined. A corrected time to detonation for a particular projectile in flight may be effected by forcing the counter 14 to a predetermined count at a predetermined interval of time prior to the corrected time of detonation. A signal representative of time $T_3$ is tapped off the counter 14 and coupled to the $T_3$ input terminal 130 of flip-flop 132 which has a J-output terminal 134. Terminal 134 is coupled to a first input terminal 136 of an AND gate 138, having a second input terminal 140 coupled to the output terminal 44 of the detector-amplifier 42, and an output terminal 142 coupled to the input terminal 54 of the "correction-address" register 52. The $T_3$ tapoff may be chronological variable responsive to the interval set into the counter 14 by the mechanical encoder 12. From time $T_3$ on, the AND gate 138 is enabled, and the remote command system is able to transmit addresses into the "correction-address" register 52. Should the remote command system transmit an address into the register 52 which is identical to the address initially inserted, during the interval $T_1$–$T_2$, into the register 46, the comparitor 62 will detect this identity and provide an output signal, at a time defined as $T_4$, to the counter, forcing the counter, irrespective of the count already therein, to a count which is a predetermined count less than the full capacity of the counter. Since the counter is filled at a fixed rate by the oscillator 66 via the scaler 72, the counter will provide a signal at its output terminal 78, at a time $T_5$, which occurs at a fixed interval of time after $T_4$. This last interval may be in the order of a tenth of a second.

It will be appreciated that each fuze is given a different address during its respective $T_1$–$T_2$ interval, which uniquely identifies it, and only that address, during the respective $T_3$–$T_4$ interval, can cause the generation of the respective $T_4$ signal to change the time of detonation of that fuze.

A first embodiment of the mechanical encoder is shown in FIGS. 4, 5 and 6. The encoder includes a stationary upper disk 100, a stationary lower disk 102, and an annulus 104 which is concentric with the disks and is journaled for rotation between the disks. A resilient pressure wheel 106 is eccentric with the annulus and is journaled for rotation between the disks. A plurality of electrically conductive, mutually isolated, conductors 108 are disposed on the periphery of the wheel 106 and bear against the inner wall 110 of the annulus. A like plurality of contacts 112 is mounted on a contact block 114 and respectively bears against the plurality of conductors 108. An outer C-shaped tape shield 116 is fixed between the disks and is open adjacent the zone of engagement, the wheel and the annulus. An inner, C-shaped, tape shield 118 is also fixed between the disks and is open adjacent the zone of engagement between the wheel and the annulus. A tape 120 is captured between the wheel 106 and the annulus wall 110. Each end of the tape is fixed to a respective pin 122, 124, which are respectively fixed between the disks. The inner face 126 of the tape carries a plurality of transverse, conductive segments 128, adapted to engage various ones on the conductors 108 on the wheel, in code-combinations. The outer face 130 of the tape carries a plurality of printed time indicia, each representative of the particular code-combination of segments on the reverse side.

The annulus 104 may be made of a translucent material such as a hard, clear plastic, whose inner surface is frosted. This will allow only that portion of the tape face 130 which is pressed against the inner surface of the annulus by the wheel 108 to be visible through this annulus. Thus only the indicia at that position will be legible, and that indicia will correspond to the code-combination established by the conductive segments of the tape and the conductors of the wheel, which code-combination will be picked up by the contacts 112, and carried out to counter 14. Rotation of the annulus causes translation of the tape behind it. The pins 122 and 124, however, anchor the ends of the tape, so that the tape cannot go beyond its minimum and maximum settings as the annulus is turned in either direction. When the end of the tape is reached, the tape is halted and slips between the annulus and the wheel. Thus, if a remote servo system is used to set the annulus, it is only necessary to rotate the annulus a minimum, predetermined number of turns, adequate to drive the tape to its end, in order to provide a known starting point for translation of the tape in the reverse direction.

An alternative embodiment of the mechanical encoder is shown in FIGS. 7 through 11. The encoder includes a plurality of assemblies 200, one for each decimal place. Each assembly, as shown in FIGS. 7A, 7B and 7C, includes a substrate 202 on which is fixed an electronic chip 204 containing a plurality of logic circuits and a plurality of leads 206, on which is disposed an array of seven conductors 208, which conductors are respectively connected by respective welded leads 210 to appropriate points in the logic circuits, the entire assembly being potted with the upper surfaces 212 of the conductors 208, and the leads 206, being exposed. To establish the number which is to be set into the counter 14, the gunner pencils over the conductors of each respective assembly the desired respective digit, thereby interconnecting certain of the conductors by means of graphite deposited from his pencil. The chip 204 serves as a seven element to binary converter according to the logic shown in FIG. 8. To change the number before firing, the gunner simply erases the previous penciling, and pencils on the new number. If a freer style of penciling is desired, the assembly 214 shown in FIG. 9, having pairs of conductors 216 may be utilized. Here the number is generated by penciling across the appropriate pairs of conductors, as shown in FIG. 10. The basic three digit display provides a setting mechanism having a resolution of 999 increments. This resolution can be increased by adding an additional pair of conductors 218 to each assembly 214 to provide a decimal point at any one of the three decades, as shown in FIG. 11. The scaler 72' contains at least two decades 220 and 222 and two AND gates 224 and 226.

What is claimed is:

1. A presettable counter, including:

counter means; and presetting means including an outer element, journaled for rotation, and having an inner surface;

an inner element journaled for rotation, having an outer surface bearing a first plurality of parallel, spaced apart, electrically insulated, elongated conductors resiliently bearing against said inner surface of said outer element;

a dielectric tape, disposed between and engaged by said inner surface of said outer element and said first plurality of conductors, and translatable by concurrent rotation of said outer and inner elements;

said tape having a second plurality of spaced apart, electrically insulated, elongated conductors upon that surface of said tape which faces said inner element, so that, as a function of such FILE NAME- FILEC04/01/76JOB NAME- 04C4573 TERMINAL STATUS- ENTRY BATCH - 00005 OPERATOR CODE- 535100MODE- ENTRY RCD - translation, different ones of said second plurality of conductors electrically interconnect different ones of said first plurality of conductors;

an additional element having a third plurality of spaced apart, electrical insulated, conductors, equal in number to said first plurality, each of said third plurality of conductors respectively engaged with a conductor of said first plurality of conductors; and a fourth plurality of conductors for electrically connecting said third plurality of conductors to said counter means.

2. A presettable counter according to claim 1 wherein:

said tape has a fifth plurality of numerical indicia upon that surface of said tape which faces said outer element, said fourth plurality being topographically correlated to said second plurality of conductors, and said outer element provides limited rectilinear light transmission therethrough whereby only the indicia on said tape immediately adjacent the contact area between the inner and outer elements is visible through said outer element.

3. A presettable counter according to claim 1 further including:

first means for translating said tape with respect to said first plurality of conductors; and second means for automatically precluding said translation in a first direction by said first means beyond a predetermined juxtaposition of said tape and said plurality of conductors, said predetermined juxtaposition serving as datum from which translation in the direction opposite to said first direction can be measured.

* * * * *

UNITED STATES PATENT OFFICE

CERTIFICATE OF CORRECTION

Patent No. 3,955,069 Dated May 4, 1976

Inventor(s) Richard T. Ziemba

It is certified that error appears in the above-identified patent and that said Letters Patent are hereby corrected as shown below:

Column 6, lines 16 through 20 after "such" the following should be deleted: "FILE NAME- FILEC04/01/76JOB NAME- 04C4573 TERMINAL STATUS- ENTRY BATCH - 00005 OPERATOR CODE- 535100MODE- ENTRY RCD -"

Signed and Sealed this

Thirty-first Day of August 1976

[SEAL]

*Attest:*

RUTH C. MASON
*Attesting Officer*

C. MARSHALL DANN
*Commissioner of Patents and Trademarks*